US008550181B2

(12) United States Patent
Kobayashi et al.

(10) Patent No.: US 8,550,181 B2
(45) Date of Patent: Oct. 8, 2013

(54) TRIGGER SWITCH AND ELECTRIC TOOL PROVIDED THEREWITH

(75) Inventors: Minoru Kobayashi, Okayama (JP); Yoshiyuki Baba, Hikone (JP); Yasushi Kamihashi, Tohaku-gun (JP)

(73) Assignee: OMRON Corporation, Kyoto (JP)

( * ) Notice: Subject to any disclaimer, the term of this patent is extended or adjusted under 35 U.S.C. 154(b) by 339 days.

(21) Appl. No.: 12/914,927

(22) Filed: Oct. 28, 2010

(65) Prior Publication Data

US 2011/0168420 A1 Jul. 14, 2011

(30) Foreign Application Priority Data

Jan. 13, 2010 (JP) ..... 2010-005034

(51) Int. Cl.
*H01H 9/06* (2006.01)
*H01H 13/06* (2006.01)

(52) U.S. Cl.
USPC ..... 173/217; 200/302.2; 200/522; 200/568; 310/50

(58) Field of Classification Search
USPC ..... 173/217, 171, 2, 170, 48; 310/47, 310/50, 230; 200/306, 534, 302.2, 50.35, 200/83 R, 303, 529, 522, 447, 520, 568
See application file for complete search history.

(56) References Cited

U.S. PATENT DOCUMENTS

| | | | | |
|---|---|---|---|---|
| 3,336,457 | A * | 8/1967 | Julian et al. | 200/306 |
| 3,898,421 | A * | 8/1975 | Suzumura | 200/517 |
| 4,241,297 | A * | 12/1980 | Piber et al. | 318/17 |
| 4,342,931 | A | 8/1982 | Grossmann et al. | |
| 4,453,061 | A | 6/1984 | Tamura | |
| 4,524,254 | A * | 6/1985 | Yoshida et al. | 200/83 R |
| 4,737,661 | A * | 4/1988 | Lessig et al. | 307/140 |
| 4,754,110 | A * | 6/1988 | Craft | 200/302.2 |
| 5,231,322 | A * | 7/1993 | Richards et al. | 310/51 |
| 5,895,900 | A * | 4/1999 | Okada et al. | 200/85 R |
| 6,645,666 | B1 * | 11/2003 | Moores et al. | 429/120 |
| 6,803,683 | B2 * | 10/2004 | Bone et al. | 310/50 |
| 7,211,758 | B2 * | 5/2007 | Lui | 200/447 |
| 7,791,232 | B2 * | 9/2010 | Purohit et al. | 310/68 B |
| 7,969,116 | B2 * | 6/2011 | Aradachi et al. | 320/114 |
| 2009/0221990 | A1 | 9/2009 | Jaeb et al. | |

FOREIGN PATENT DOCUMENTS

| | | |
|---|---|---|
| JP | 06-018092 | 9/1994 |
| TW | 200942276 A | 10/2009 |

OTHER PUBLICATIONS

English Abstract of Japanese Patent Application, Publication No. 06-018092, dated: Sep. 3, 1994, 1 page.
Extended European Search Report for Application No. 10174189.0 dated Jul. 21, 2011 (7 pages).
Office Action Issued in Taiwanese Application No. 099136643, Dated: May 8, 2013 (11 Pages with English Translation).

* cited by examiner

*Primary Examiner* — Scott A. Smith
(74) *Attorney, Agent, or Firm* — Osha Liang LLP

(57) ABSTRACT

An electric tool has a rib projecting from an inner peripheral surface of the electric tool, and a trigger switch. The trigger switch has a housing having a housing venthole, a contact mechanism disposed in the housing, and a trigger that, when depressed into the housing, drives the contact mechanism. The housing of the trigger switch is bonded to the rib. The rib has a rib venthole. The housing venthole is communicated with the rib venthole. The rib venthole is covered with a filter.

9 Claims, 11 Drawing Sheets

TRIGGER SWITCH AND ELECTRIC TOOL PROVIDED THEREWITH

BACKGROUND OF THE INVENTION

1. Technical Field

The present invention relates to a trigger switch used in an electric tool and the like.

2. Related Art

Conventionally, for example, Japanese Patent Publication No. 6-18092 proposes that a seal material is bonded to a case of which micro-grooves are provided in a surface so as to prevent an adverse effect of expansion of air and an adverse effect of dust and the like on a switch. However, when the dust-resistant structure proposed in Japanese Patent Publication No. 6-18092 is applied to the trigger switch, the dust and water invade easily into the trigger switch from the micro-grooves by pumping action caused by a manipulation of a trigger, which possibly causes the adverse effect on a contact mechanism. For example, in the trigger switch, there is a risk that rainwater invades during work to generate a short circuit. In order to prevent the adverse effect, there is also made a proposal that bonding surfaces of covers constituting a housing are sealed by ultrasonic welding to enhance a water-resistant property and a dust-resistant property.

However, when the bonding surfaces of the covers are sealed by the ultrasonic welding, internal air hardly flows to the outside, and air resistance is increased when the trigger is depressed, which results in a strange manipulation feeling.

SUMMARY

One or more embodiments of the present invention provides a trigger switch in which manipulation performance is improved while the dust-resistant property and the water-resistant property are secured.

In accordance with one aspect of the present invention, there is provided a trigger switch that depresses a trigger in a housing to drive a contact mechanism of the housing, wherein a filter with which a venthole made in the housing is covered is provided in an outer surface of the housing.

According to one or more embodiments of the present invention, the ventilation property can be secured through the filter, and the dust-resistant property and the water-resistant property can be secured while the manipulation performance is maintained. Particularly, assembling work is easily performed because the filter is provided in the outer surface of the housing.

In accordance with another aspect of the present invention, there is provided a trigger switch that depresses a trigger in a housing to drive a contact mechanism of the housing, wherein a filter with which a venthole made in the housing is covered is provided in an inner surface of the housing.

According to one or more embodiments of the present invention, the ventilation property can be secured through the filter, and the dust-resistant property and the water-resistant property can be secured while the manipulation performance is maintained. Particularly, the filter hardly drops off because the filter is provided in the inner surface of the housing.

According to the present embodiment, the filter may be a microfilter having micro-holes of 0.1 μm to 10 μm through which water vapor (diameter of 0.0004 μm) is passed while rainwater (100 μm to 3000 μm) is not passed.

According to the aspect, the venthole is made in a sidewall of the housing, the sidewall of the housing being orthogonal to a direction in which the trigger is reciprocally moved.

According to the present embodiment, the internal air is smoothly vented by piston action caused by the reciprocating movement of the trigger, and the trigger switch having the better manipulation feeling is obtained.

In accordance with still another aspect of the present invention, there is provided an electric tool provided with a trigger switch that depresses a trigger in a housing to drive a contact mechanism provided in the housing, wherein the housing of the trigger switch is bonded to a rib projected from an inner peripheral surface of the electric tool, a venthole made in the housing is communicated with a venthole made in the rib, and the venthole made in the rib is covered with a filter.

According to one or more embodiments of the present invention, the electric tool provided with the good-manipulation-feeling trigger switch that can prevent the invasion of the dust and water is obtained because the internal air can flow to the outside through the filter with which the venthole made in the rib is covered.

In accordance with still another aspect of the present invention, there is provided a trigger switch that depresses a trigger in a housing to drive a contact mechanism of the housing, wherein a filter is disposed such that, in bonding surfaces of a first cover and a second cove that constitute the housing, a gap between bonding surfaces that are not welded is covered from an inside.

According to one or more embodiments of the present invention, the internal air can flow to the outside through the filter with which the gap between the bonding surfaces is covered, the trigger switch that can prevent the invasion of the dust and water from the outside while improving the manipulation feeling is obtained.

The filter may be formed by a micro-porous elastic body, particularly by a flexible polyurethane foam.

According to the present embodiment, because the filter is easily elastically deformed, advantageously the assembling work is easy to perform.

DETAILED DESCRIPTION

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A trigger switch according to a first embodiment of the invention is applied to an electric drill as shown in FIGS. 1 to 5.

Figure 1A:
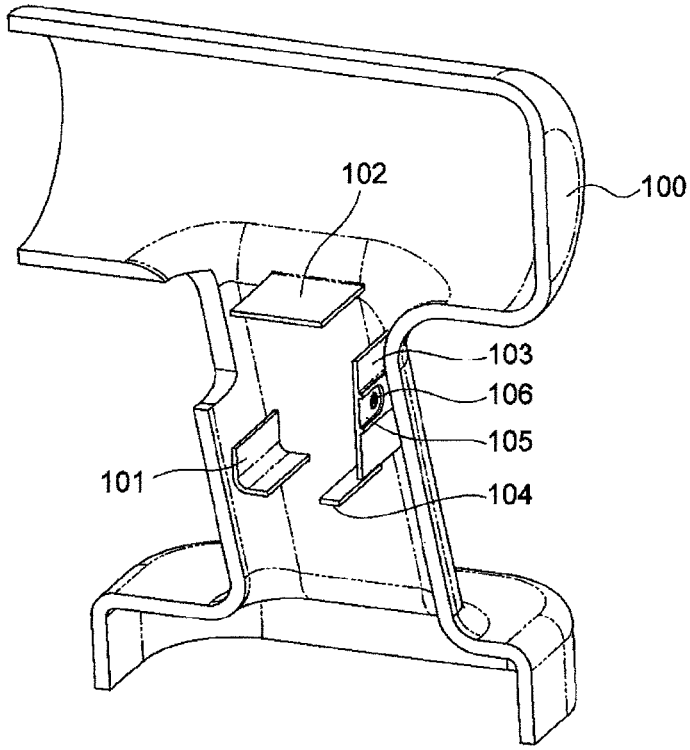
FIG. 1A is a perspective view showing one of casings of an electric drill.
Figure 1B:
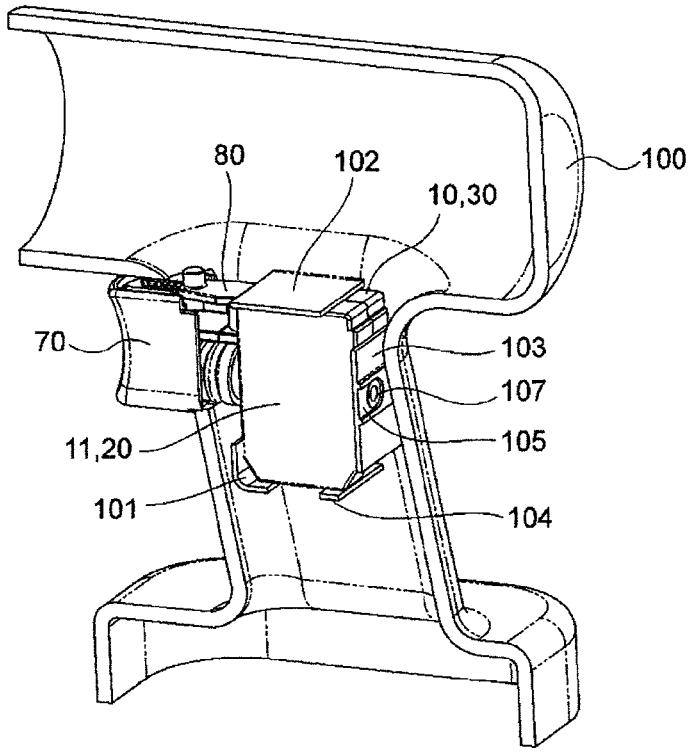
FIG. 1B is a perspective view showing a state in which a trigger switch according to a first embodiment of the invention is assembled in the casing.
Figure 2A:
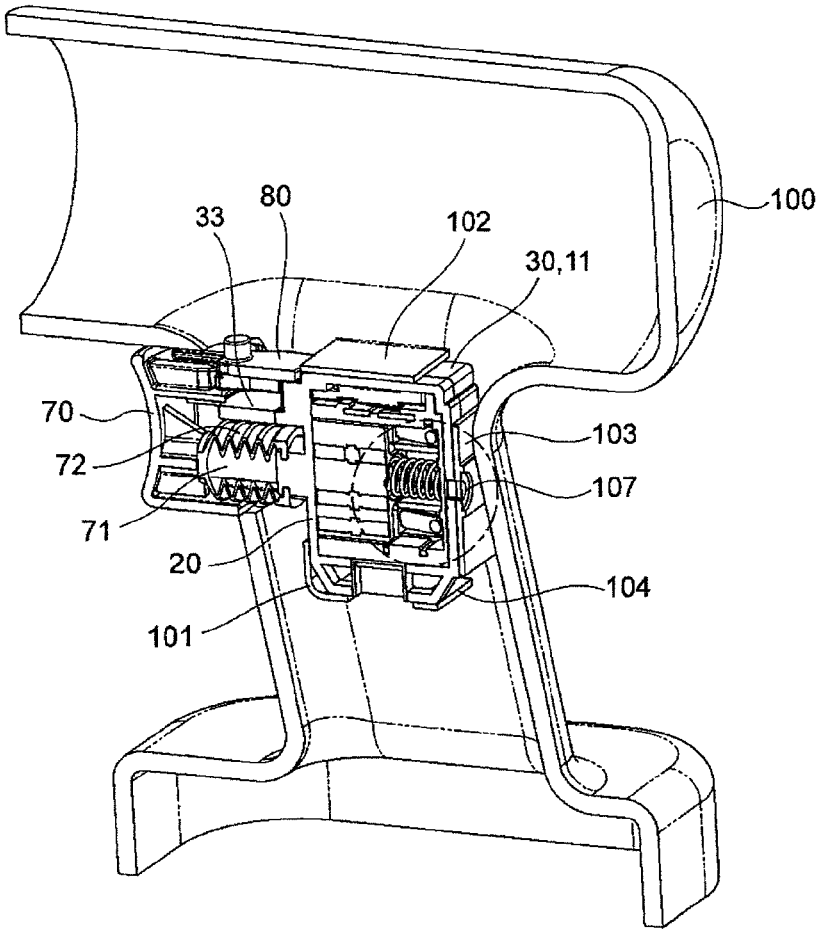
FIG. 2A is a partially sectional perspective view of FIG. 1B.
Figure 2B:
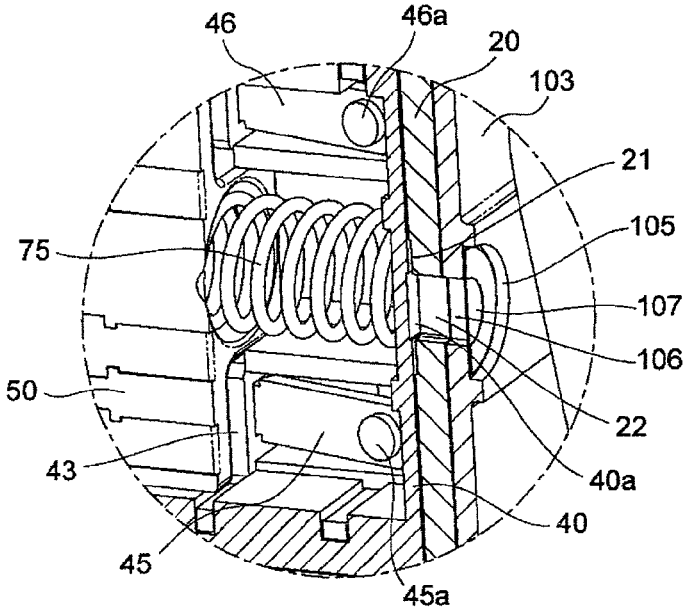
FIG. 2B is a partially enlarged perspective view of FIG. 2A.

As shown in FIGS. 1 and 2, a trigger switch 10 is assembled in positioning ribs 101, 102, 103, and 104 that are projected from an inner peripheral surface of a casing 100 on one side of the electric drill. Particularly a venthole 106 is made on depth side of a shallow-groove-shaped step 105 provided in an outward surface of the rib 103 while covered with a filter 107. The rib 103 comes in surface contact with a side face of the trigger switch 10, the venthole 106 made in the rib 103 is located at a position corresponding to a venthole 22 made in the trigger switch 10, and the venthole 106 and the venthole 22 are communicated with each other.

The filter 107 has a ventilation property, a water-resistant property, and a dust-resistant property. A microfilter in which water vapor (diameter of 0.0004 μm) can pass therethrough while rainwater (100 μm to 3000 μm) does not pass therethrough can be cited as an example of the filter 107. More specifically, a microfilter made of a tetrafluorinated ethylene resin porous film having micro-holes (0.1 μm to 10 μm) and excellent heat resistant property, chemical-resistant property, weather-resistant property, electric characteristic, and water repellent property can be cited as the filter 107.

Figure 3:
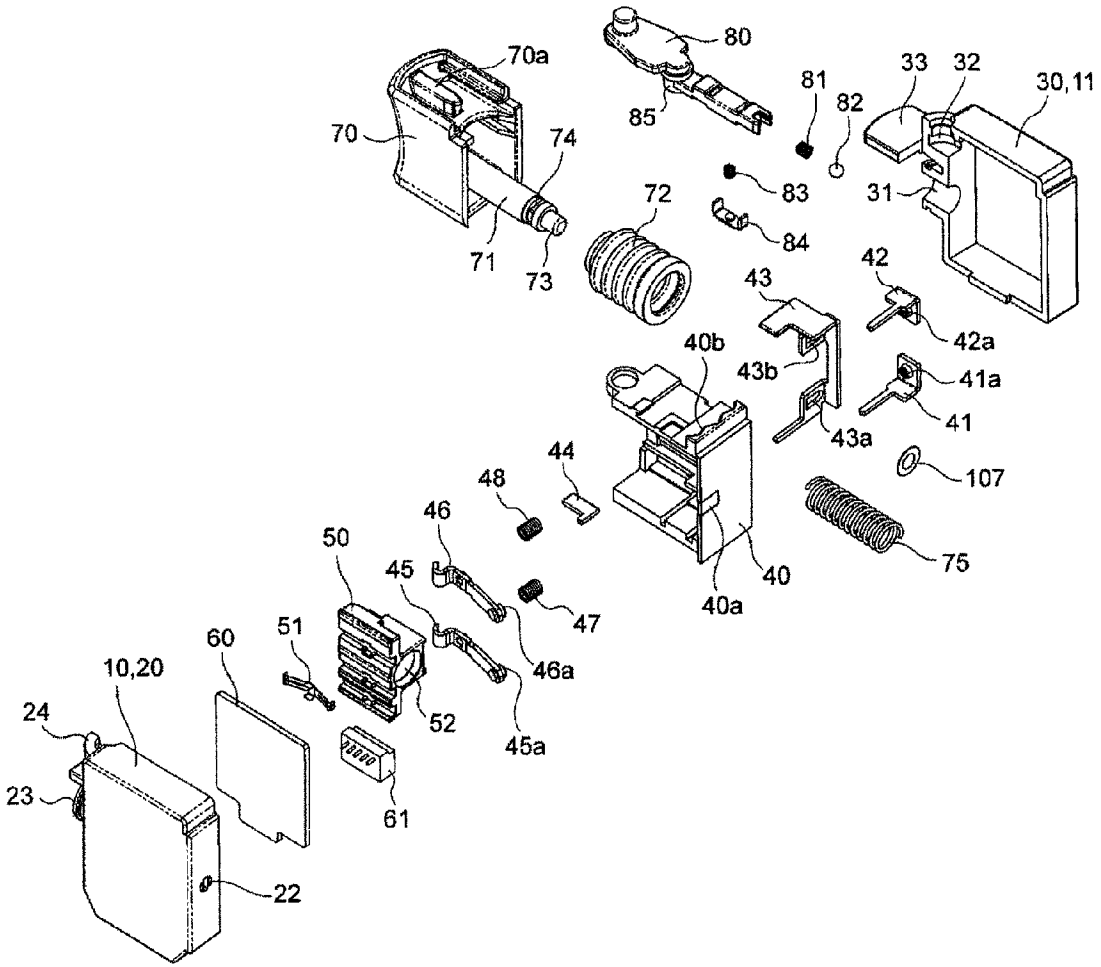
FIG. 3 is an exploded perspective view of the trigger switch of FIG. 1B.

As shown in FIG. 3, in the trigger switch 10, inside components such as a base 40, a plunger 50, and a printed board 60 are incorporated in a housing 11 that is formed by combining a first cover 20 and a second cover 30, and a trigger 70 and a manipulation lever 80 are assembled.

Figure 4:
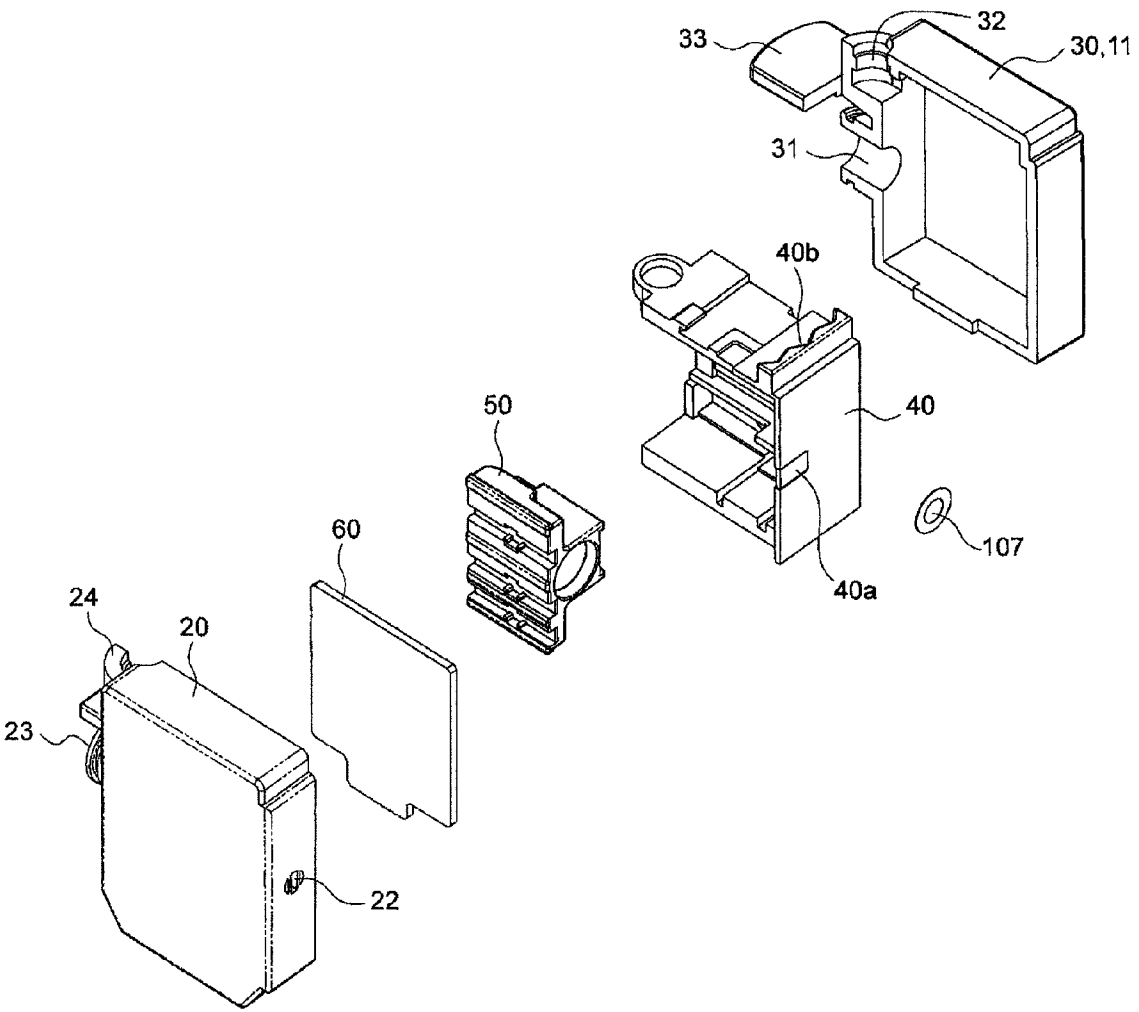
FIG. 4 is an enlarged exploded perspective view showing main components of the trigger switch of FIG. 3.
Figure 5:
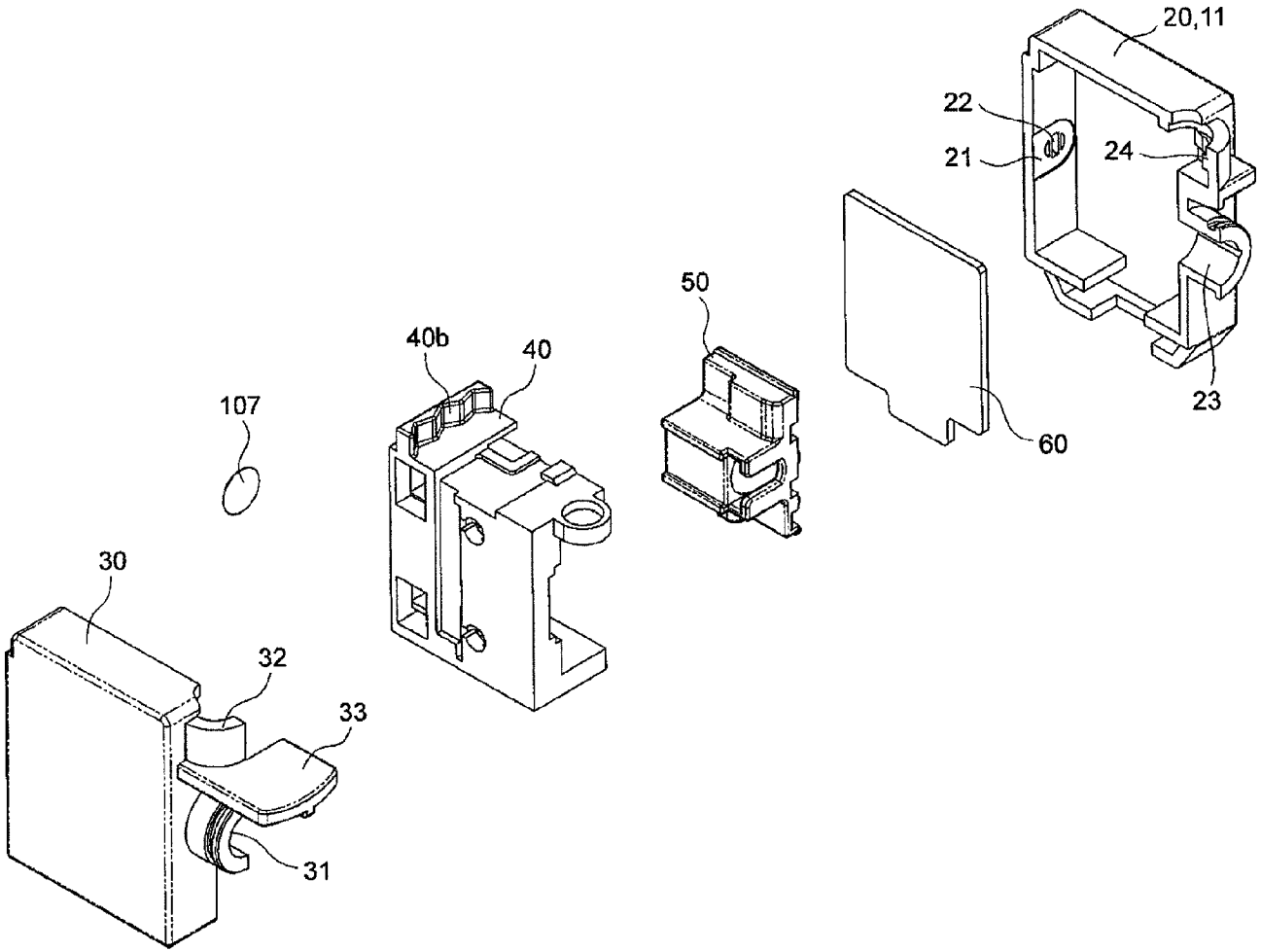
FIG. 5 is an enlarged exploded perspective view showing the main components of the trigger switch of FIG. 3 when viewed from a different angle.

As shown in FIGS. 4 and 5, the venthole 22 is made in a shallow step 21 provided in an inner side face on one side of the first cover 20, and a semicircular rib 23 that supports a manipulation shaft 71 of the trigger 70 and a quadrant rib 24 that supports the manipulation lever 80 are provided on a side face opposite to the inner side face.

The second cover 30 has a front-face shape that can be matched with the first cover 20. In the second cover 30, ribs 31 and 32 are projected at positions corresponding to ribs 23 and 24 of the first cover 20, and a guide piece 33 is laterally projected. In bonding surfaces of the second cover 30, the bonding surfaces except portions to which the trigger 70, the manipulation lever 80, and a connector 61 are attached are bonded to the first cover 20 by ultrasonic welding.

As shown in FIG. 3, an air vent step 40*a* is formed in a side-face edge portion of the base 40, and a click feeling waved surface 40*b* is formed in an upper surface of the base 40. In the base 40, first and second fixed contact terminals 41 and 42 and a common terminal 43 are press-fitted from one side, and a switching contact terminal 44 is assembled from the other side. In the common terminal 43 press-fitted in the base 40, first and second moving contact piece 45 and 46 are inserted in engagement holes 43*a* and 43*b* that are made in an extending portion projected from the base 40, thereby turnably supporting the first and second moving contact piece 45 and 46. Positioning coil springs 47 and 48 are assembled in the base 40, whereby the first and second moving contact piece 45 and 46 are biased so as to return automatically and not to drop off. Therefore, first and second moving contacts 45*a* and 46*a* of the first and second moving contact pieces 45 and 46 face first and second fixed contacts 41*a* and 42*a* of the first and second fixed contact terminals 41 and 42 so as to be able to be brought into contact with and separated from the first and second fixed contacts 41*a* and 42*a*.

The plunger 50 is slidably fitted in the base 40, and a slider 51 is attached to the outward side face of the plunger 50. The slider 51 attached to the outward side face of the plunger 50 is slid along a sliding resistor (not shown) of a printed board 60, thereby changing a resistance value.

The printed board 60 has a front-face shape that can be accommodated in the first and second covers 20 and 30, and is electrically connected to the connector 61, and a sliding resistor (not shown) is printed in the inward surface of the printed board 60. The printed board 60 is positioned in the base 40 in which the plunger 50 is accommodated, and the first and second fixed contact terminal 41 and 42, common terminal 43, and switching contact terminal 44, which are assembled in the base 40, are inserted in terminal holes (not shown) and electrically connected to the printed board 60 by soldering, thereby integrating the printed board 60 and the base 40.

In the trigger 70, the laterally-projected manipulation shaft 71 is inserted in a bellows-shaped cylindrical body 72, a notched groove 74 provided near a projected leading end portion 73 is slide-engaged in the plunger 50, and one end portion of the returning coil spring 75 is fitted in the leading end portion 73. The other end portion of the returning coil spring 75 is projected from a through-hole 52 of the plunger 50 to abut on the inner side surface of the base 40. Therefore, the returning coil spring 75 biases the trigger 70 and the plunger 50 so as to outwardly push out the trigger 70 and the plunger 50 from the housing 11.

In the bellows-shaped cylindrical body 72, one end portion is elastically fitted in a base portion of the manipulation shaft 71, and the other end portion is elastically fitted in a cylindrical portion that is formed by bonding the ribs 23 and 31 of the first and second covers 20 and 30, thereby preventing water from invading from a periphery of the manipulation shaft 71.

In the manipulation lever 80, a steel ball 82 is assemble in one end portion so as to be biased outward with a manipulation-lever coil spring 81 interposed therebetween, and a switching moving contact 84 is assembled in a lower surface on one end side with a switching coil spring 83 interposed therebetween. A shaft portion 85 of the manipulation lever 80 is fitted in a bearing portion formed by aligning the ribs 24 and 32 of the first and second covers 20 and 30, thereby turnably supporting the manipulation lever 80.

Accordingly, after the inside components are assembled in the first and second covers 20 and 30, the bonding surfaces of the first and second covers 20 and 30 are integrated by the ultrasonic welding to sandwich the manipulation shaft 71 of the trigger 70 between the first and second covers 20 and 30. The other end portion of the bellows-shaped cylindrical body 72 is elastically fitted in the ribs 23 and 31 of the first and second covers 20 and 30 to complete the assembling work of the trigger switch 10.

After the trigger switch 10 is assembled in the ribs 101, 102, 103, and 104 that are projected in a casing 100 on one side of the electric drill, the trigger switch 10 is connected to a motor (not shown) through the connector 61, and a casing (not shown) on the remaining one side is assembled.

In the first embodiment, the internal air flows out through the venthole 22 of the first cover 20 from the air vent step 40*a* provided in the side face of the base 40, and then further flows to the outside through the filter 107 from the venthole 106 made in the rib 103 of the casing 100 of the electric drill.

Because the filter 107 has the ventilation property, the dust-resistant property, and the water-resistant property, the filter 107 can prevent the invasion of the dust or water from the outside, and the electric tool that has the dust-resistant property and the water-resistant property while maintaining the manipulation performance is advantageously obtained.

A manipulation of the trigger switch will briefly be described below.

When the manipulation lever 80 is located at a neutral position, one end portion of the manipulation lever 80 abuts on a central projection 70*a* of the trigger 70. Therefore, the trigger 70 is not depressed, but a malfunction is prevented.

Immediately before the manipulation lever 80 is rotated counterclockwise to depress the trigger 70, the slider 51 comes into contact with the sliding resistor (not shown) of the printed board 60 with the maximum resistance value. On the other hand, the first and second moving contact pieces 45 and 46 are biased by the coil springs 47 and 48, and the first and second moving contacts 45*a* and 46*a* are separated from the first and second fixed contacts 41*a* and 42*a*.

The plunger 50 engaged in the manipulation shaft 71 is slid-moved when a worker slightly depresses the trigger. Therefore, the first moving contact piece 45 is turned to bring the first moving contact 45*a* into contact with the first fixed contact 41*a*. As a result, a small current is passed to start rotation of a motor (not shown) at a low speed.

The trigger 70 is depressed, the resistance value is decreased as the slider 51 assembled in the plunger 50 is slid on the sliding resistor of the printed board 60, and the current is increased to increase the number of rotations of the motor.

When the trigger 70 is further depressed to push the manipulation shaft 71 onto the depth side of the base 40, the second moving contact piece 46 is turned to bring the second moving contact 46*a* into contact with the second fixed contact 42*a*, whereby the maximum current is passed to maximize the number of rotations of the motor.

When the worker releases the force for depressing the trigger 70, the plunger 50 and the manipulation shaft 71 are pushed back by the spring force of the returning coil spring 75 to return to the original state. Therefore, the number of rotations of the motor is gradually decreased and the motor is stopped.

On the other hand, the manipulation lever 80 is rotated clockwise about a rotating shaft 85, the switching moving contact 84 connects the common terminal 43 and the switching contact terminal 44, and the trigger 70 is similarly manipulated, which allows the motor to be reversely rotated.

In the sidewalls of the first cover 20 of the first embodiment, because the venthole 22 is disposed in the sidewall orthogonal to the direction in which the plunger 50 is reciprocally moved, the internal air is smoothly vented, and the air resistance is not increased. Therefore, the good manipulation feeling is advantageously obtained.

In the first embodiment, since the filter 107 is integrally bonded to the outside of the trigger switch 10, it is not necessary that the filter 107 have the high heat-resistant property and chemical-resistant property, but the inexpensive filter 107 can advantageously be used.

In the first embodiment, the venthole 106 made in the rib 103 of the electric drill is covered from the outside with the filter 107. Alternatively, the venthole 106 may be covered from the inside of the rib 103 with the filter 107 and sandwiched between the rib 103 and the housing 11 of the trigger switch 10.

The filter 107 may directly be bonded to the trigger switch 10. For example, the venthole 22 of the first cover 20 may be covered from the outside or inside with the filter 107. Particularly, when the venthole 22 of the first cover 20 is covered from the inside with the filter 107, advantageously the filter 107 hardly drops off because the filter 107 is sandwiched between the first cover 20 and base 40.

The filter 107 is not limited to the case where the venthole made in the bonding surface to the rib is covered, but obviously the venthole made in the position that is not bonded to the rib may be covered from the inside or outside.

As shown in FIGS. 6 to 11, a trigger switch according to a second embodiment of the invention differs from that of the first embodiment in a water-resistant structure. Because the basic structure of the trigger switch of the second embodiment is substantially similar to that of the first embodiment, the same component is designated by the same numeral, and the description is not given.

Figure 6A:
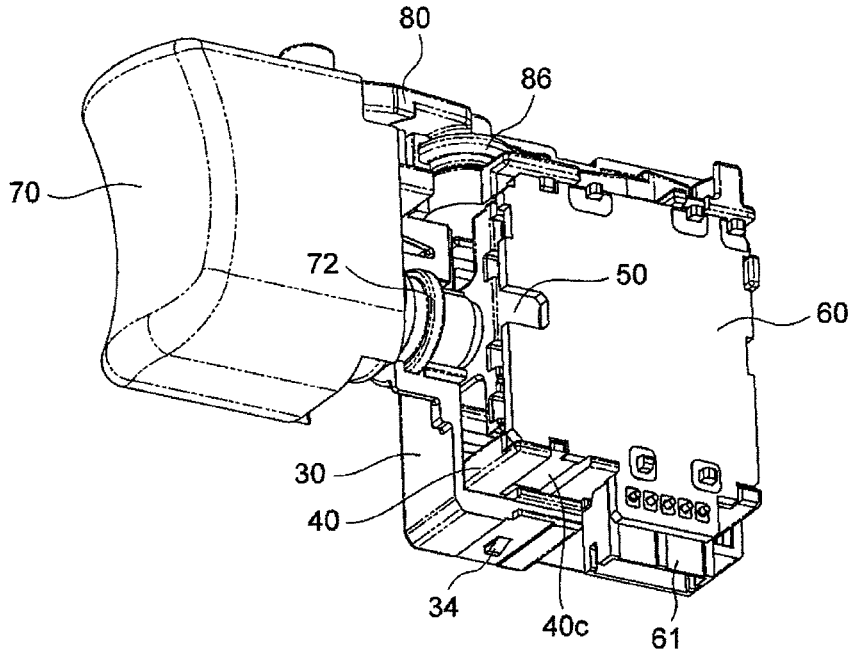
FIGS. 6A and 6B are perspective views showing a trigger switch according to a second embodiment of the invention.
Figure 6B:
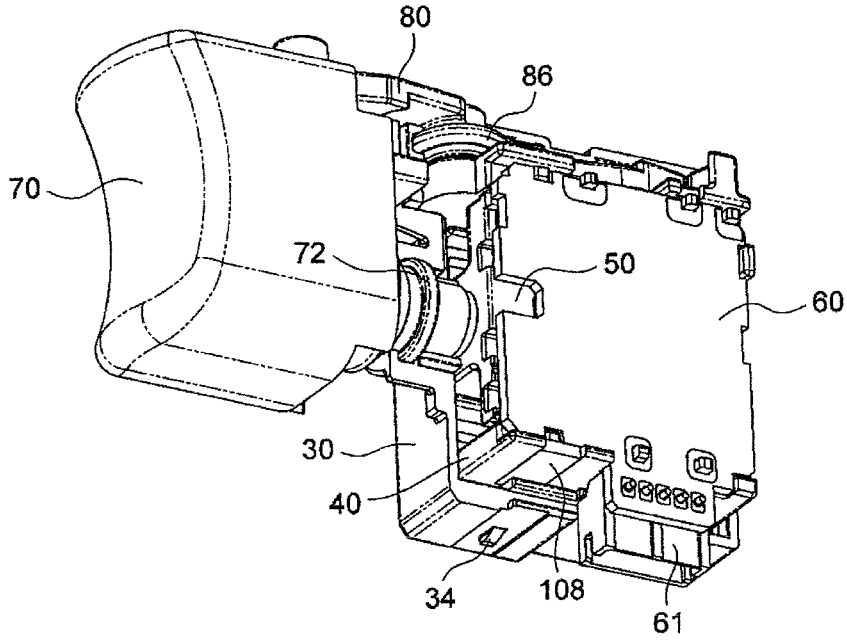

As shown in FIG. 6, in the trigger switch 10 of the second embodiment, a micro-porous elastic body 108 that is of the filter is assembled in a step 40*c* provided in a bottom surface of the base 40, the internal air is caused to flow out from a gap between the bonding surfaces of the first cover 20 and second cover 30, thereby securing the ventilation property.

That is, in the second embodiment, an elastic engagement portion 25 of the first cover 20 and an engagement bracket 34 of the second cover 30 are engaged in each other and temporarily joined. Then the bonding surfaces of the first and second covers 20 and 30 are integrated by performing the ultrasonic welding or laser welding to a welding rib 26 provided in the first cover 20 shown in FIG. 11.

Figure 7A:
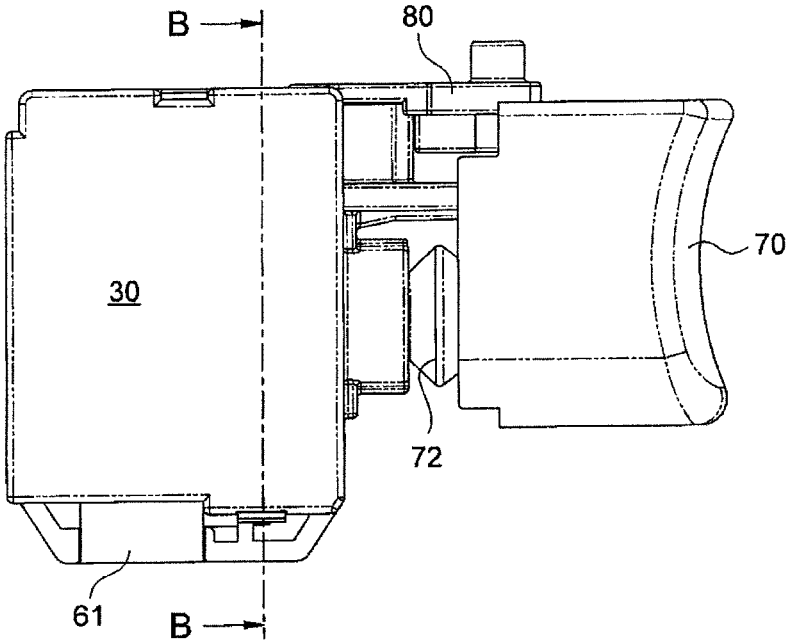
FIG. 7A is a rear view of the trigger switch of FIG. 6.
Figure 7B:
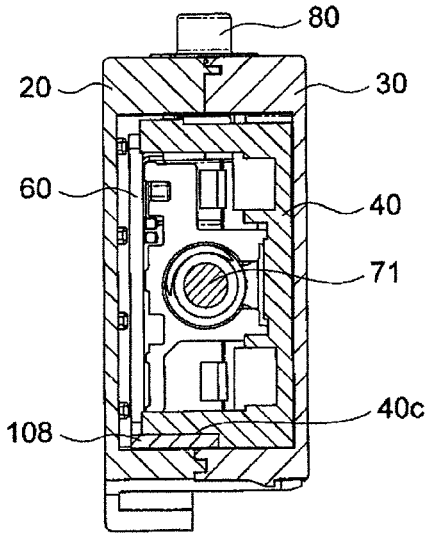
FIG. 7B is a sectional view taken on a line B-B of FIG. 7A.
Figure 8:
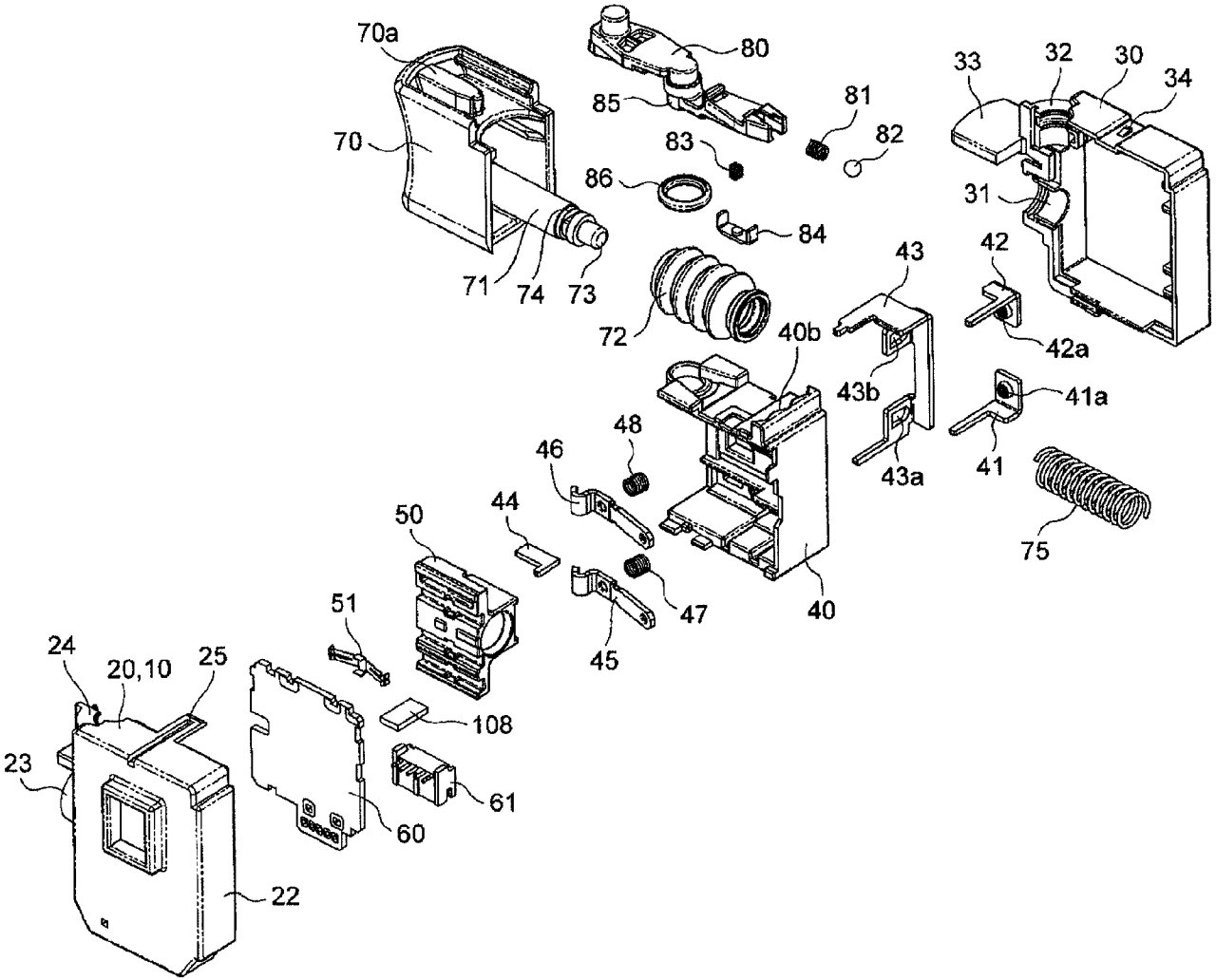
FIG. 8 is an exploded perspective view of the trigger switch of FIG. 6.

However, the bonding surfaces of the first cover 20 and second cover 30, which are located near the step 40*c* provided in the bottom surface of the base 40, are not integrally welded, but are simply fitted as shown in FIG. 7B.

In the bonding surface that is not integrally welded, the water-resistant structure is established by utilizing the bellows-shaped cylindrical body 72 around the manipulation shaft 71, and is established by utilizing a seal ring 86 around the shaft portion 85 of the manipulation lever 80.

A flame-resistant polyurethane foam can be cited as an example of the micro-porous elastic body 108. More specifically, a polyether-system flexible polyurethane foam having a spontaneous ignition temperature of 416° C. and relative density of 28 kg/m$^3$ can be cited as the micro-porous elastic body 108.

Figure 9:
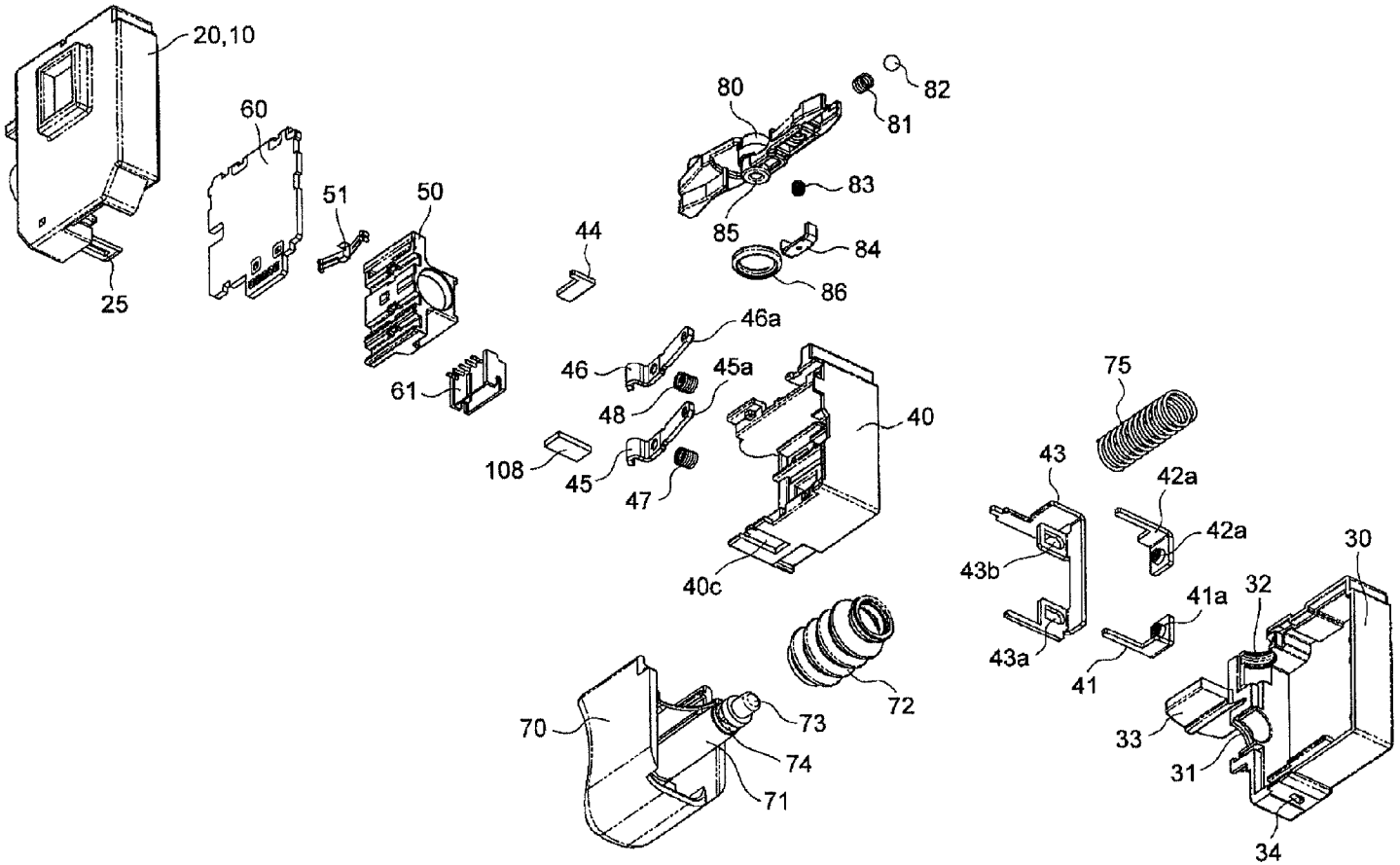
FIG. 9 is an exploded perspective view of the trigger switch of FIG. 6 when viewed from a different angle.
Figure 10:
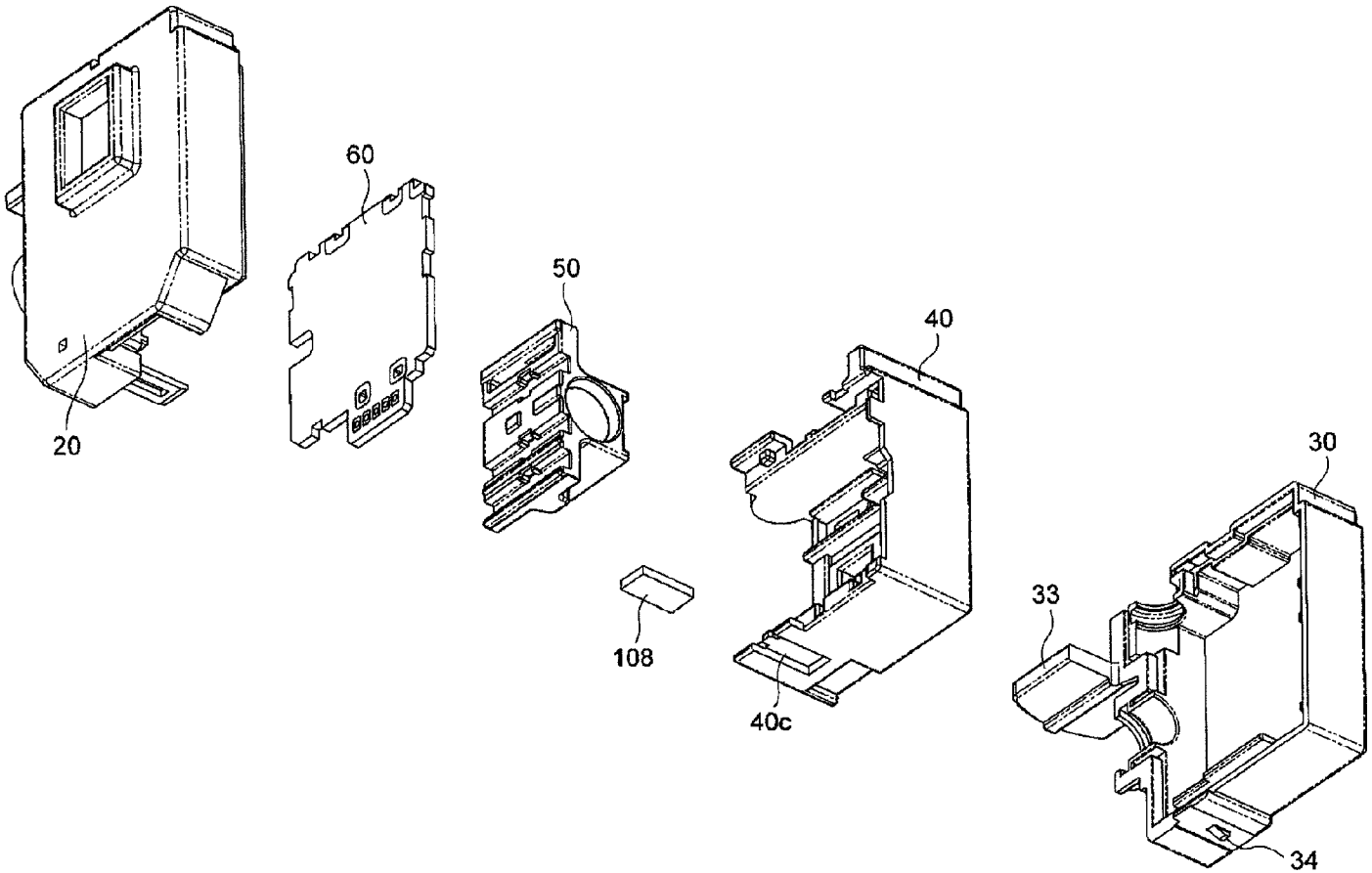
FIG. 10 is an enlarged exploded perspective view showing main components of the trigger switch of FIG. 9.
Figure 11:
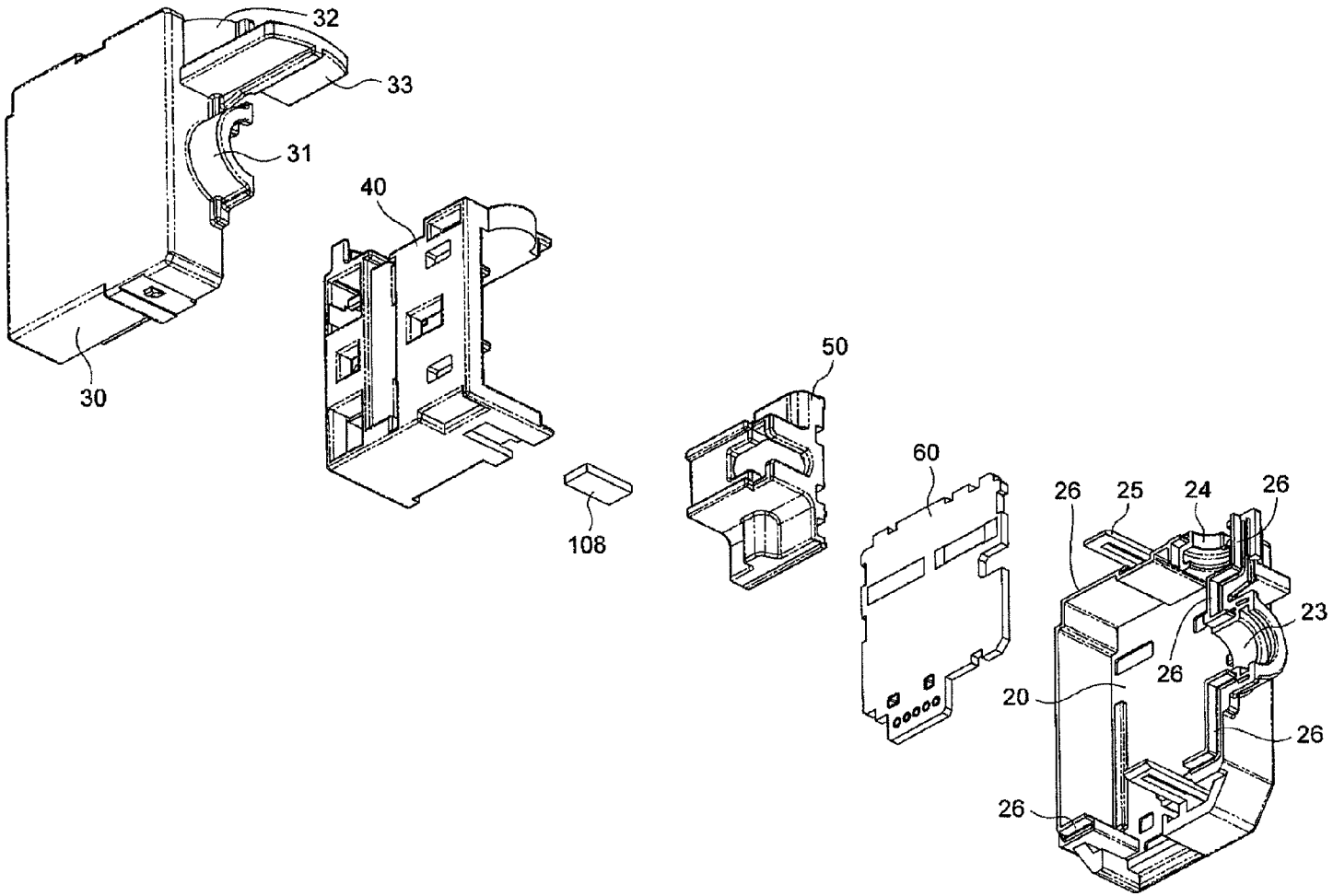
FIG. 11 is an enlarged exploded perspective view showing the main components of the trigger switch of FIG. 9 when viewed from a different angle.

Accordingly, as shown in FIG. 9, the micro-porous elastic body 108 is positioned in the step 40*c* provided in the bottom surface of the base 40, whereby the air in the housing 10 passes through the micro-porous elastic body 108 to flow to the outside from the gap between the bonding surfaces of the first cover 20 and second cover 30, which are not welded.

Because the manipulation of the trigger switch 10 of the second embodiment is substantially similar to that of the first embodiment, the description is not given.

The trigger switch of one or more embodiments of the invention can be applied to not only the electric drill but also other electric tools.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A trigger switch for an electric tool having a rib with a rib venthole projecting from an inner peripheral surface of the electric tool, comprising:

a housing comprising a housing venthole;

a contact mechanism disposed in the housing;

a trigger that, when depressed into the housing, drives the contact mechanism; and a filter with which the housing venthole is covered provided on an outer surface of the housing, wherein the housing of the trigger switch is configured to be bonded to the rib, wherein the housing venthole is configured to be communicated with the rib venthole, and wherein the filter is configured to cover the rib venthole.

2. The trigger switch according to claim 1, wherein the filter is a microfilter having micro-holes of 0.1 μm to 10 μm, which allows water vapor to pass through, while preventing rainwater from passing through.

3. The trigger switch according to claim 2, wherein the venthole is made in a sidewall of the housing, the sidewall of the housing being orthogonal to a direction in which the trigger is reciprocally moved.

4. The trigger switch according to claim 1, wherein the venthole is made in a sidewall of the housing, the sidewall of the housing being orthogonal to a direction in which the trigger is reciprocally moved.

5. A trigger switch for an electric tool having a rib with a rib venthole projecting from an inner peripheral surface of the electric tool, comprising:

a housing comprising a housing venthole;

a contact mechanism disposed in the housing;

a trigger that, when depressed into the housing, drives the contact mechanism; and a filter with which the housing venthole is covered provided on an inner surface of the housing, wherein the housing of the trigger switch is configured to be bonded to the rib, wherein the housing venthole is configured to be communicated with the rib venthole, and wherein the filter is configured to cover the rib venthole.

6. The trigger switch according to claim 5, wherein the filter is a microfilter having micro-holes of 0.1 μm to 10 μm, which allows water vapor to pass through while preventing rainwater from passing through.

7. The trigger switch according to claim 6, wherein the venthole is made in a sidewall of the housing, the sidewall of the housing being orthogonal to a direction in which the trigger is reciprocally moved.

8. The trigger switch according to claim 5, wherein the venthole is made in a sidewall of the housing, the sidewall of the housing being orthogonal to a direction in which the trigger is reciprocally moved.

9. An electric tool comprising:

a rib projecting from an inner peripheral surface of the electric tool; and a trigger switch comprising: a housing comprising a housing venthole;

a contact mechanism disposed in the housing; and a trigger that, when depressed into the housing, drives the contact mechanism, wherein the housing of the trigger switch is bonded to the rib, wherein the rib comprises a rib venthole, wherein the housing venthole is communicated with the rib venthole, and wherein the rib venthole is covered with a filter.

* * * * *